US006789448B2

(12) United States Patent
Ono et al.

(10) Patent No.: US 6,789,448 B2
(45) Date of Patent: Sep. 14, 2004

(54) POWER RATCHET WRENCH

(75) Inventors: Akira Ono, 3-85, Sakurayamadai, Higashimatsuyama, Saitama (JP); Akio Yumoto, Kumagaya (JP)

(73) Assignees: Saitama Seiko Kabushiki Kaisha, Saitama (JP); Akira Ono, Saitama (JP)

( * ) Notice: Subject to any disclaimer, the term of this patent is extended or adjusted under 35 U.S.C. 154(b) by 18 days.

(21) Appl. No.: 10/164,195

(22) Filed: Jun. 5, 2002

(65) Prior Publication Data

US 2002/0184975 A1 Dec. 12, 2002

(30) Foreign Application Priority Data

Jun. 11, 2001 (JP) ..... 2001-175310

(51) Int. Cl.[7] ..... B25B 17/00; B25B 13/46
(52) U.S. Cl. ..... 81/57.39; 81/57.13
(58) Field of Search ..... 81/57.39, 62, 63.1, 81/57.29, 57.13; 74/116, 118

(56) References Cited

U.S. PATENT DOCUMENTS 2,711,111 A * 6/1955 Brame ..... 81/58.2
4,346,630 A * 8/1982 Hanson ..... 81/57.13
5,142,952 A * 9/1992 Putney et al. ..... 81/57.39
5,237,885 A * 8/1993 Putney et al. ..... 74/116

FOREIGN PATENT DOCUMENTS

| | | |
|---|---|---|
| JP | S63-28571 | 2/1988 |
| JP | S63-256373 | 10/1988 |
| JP | H06-35115 | 5/1994 |
| JP | H10-217140 | 8/1998 |
| JP | 2001-30179 | 2/2001 |

* cited by examiner

*Primary Examiner*—Lee D Wilson
(74) *Attorney, Agent, or Firm*—Koda & Androlia

(57) ABSTRACT

A power ratchet wrench including a yoke that is in sliding contact with opposing faces of a distal end bifurcated portion of the wrench housing, guide bushings fitted and fixed in the distal end bifurcated portion and inserted in the hole of the yoke to support the yoke, a spindle inserted in the yoke, and a protruding member that prevents the spindle from being pulled out. The spindle that turns a workpiece is supported by the guide bushings. The motion converter of the wrench includes a swing lever rotatable in a back-and-forth fashion in the wrench housing; and the engagement portion at one end of the swing lever engages a ball on an eccentric shaft of a speed-reduction assembly, and a cylindrical portion at another end of the swing lever is slidably engaged with a U-shaped groove of the yoke.

1 Claim, 5 Drawing Sheets

POWER RATCHET WRENCH

BACKGROUND OF THE INVENTION

1. Field of the Invention

The present invention relates to a power ratchet wrench and more particularly to an improvement in a power ratchet wrench for mounting and dismounting threaded items such as bolts, nuts and screws in, for instance, assembling, disassembling and maintaining automobiles and various other devices and structures.

2. Prior Art

Prior art power ratchet wrenches are disclosed in, for instance, Japanese Patent Application Laid-Open Nos. S63-28571, S63-256373, H6-35115 (S61-260982), H10-217140, and 2001-30179.

In these power ratchet wrenches, two sides of a yoke are received by opposing faces of a distal end bifurcated portion of a housing, and a spindle having a workpiece engagement portion, a small diameter portion, and a large diameter portion is inserted inside the yoke. The rotary motion of a motor provided on a proximal side of the housing is transmitted through a motion converter that converts a rotary motion into a reciprocal swing motion, thereby reciprocally rotating the yoke by way of using a center line of the spindle as a center of its rotational-motion, so that a ratchet pawl of a ratchet mechanism installed in a space inside the large diameter portion of the spindle is alternately engaged with and disengaged from an internal teeth formed around an inner peripheral surface of a hole of the yoke, thus causing the spindle to rotate in steps and causing a workpiece, such as a bolt, nut, screw, and the like, to turn with a workpiece engagement portion provided at one end of the spindle.

In above power ratchet wrenches, the internal teeth of the yoke are supported in the large diameter portion of the spindle. This structure will be described in detail with reference to FIG. 5.

Two sides of a yoke 1 are received by the opposing faces of the retaining elements 2*b*' and 2*b*" of the distal end bifurcated portion of a housing 2; and the yoke 1, using the center line of the spindle 3 inserted in the yoke 1 as its rotational center, reciprocally rotates by a motor 4 provided inside the proximal side of the housing 2 through a speed-reduction assembly 5, a power transmission shaft 6, and a motion converter 7 that converts a rotary motion into a reciprocal swing motion. As a result, the ratchet pawl 8*a* of a ratchet mechanism 8 installed inside the large diameter portion 3*c* of the spindle 3 is alternately engaged with and disengaged from an internal teeth 1*a* of the yoke 1, thus causing the spindle 3 to rotate in steps and to turn the workpiece, such as a bolt, nuts and screws, with the workpiece engagement portion 3*a* provided at the distal end of the spindle 3.

The power ratchet wrench disclosed in Japanese Patent Application Publication (Kokoku) H6-35115 has a hammer structure that provides hammer rotation in place of the speed-reduction assembly 5.

As generally known, the ratchet mechanism 8 comprises a ratchet pawl 8*a*, a pin shaft 8*b* on which the middle portion of the ratchet pawl 8*a* pivots, a knob shaft 8*c* fitted in a hole made in the end face on the large diameter portion 3*c* of the spindle 3, a spring 8*d* housed in a side hole of the knob shaft 8*c*, and a pin 8*e* that is biased by the spring 8*d* so as to be pressed into a recess on the back of the ratchet pawl 8*a*.

This mechanism is designed so that the location where the push pin 8*e* presses can be varied by twisting the knob shaft 8*c* to either the right or the left. When the knob shaft 8*c* is twisted to the right, the right-hand portion of the ratchet pawl 8*a* is alternately engaged with and disengaged from the internal teeth 1*a* of the yoke 1, so that the spindle 3 is rotated in steps to the right. When the knob shaft 8*c* is twisted to the left, the left-hand portion of the ratchet pawl 8*a* is alternately engaged with and disengaged from the internal teeth 1*a* of the yoke 1, so that the spindle 3 is rotated in steps to the left.

Two sides of the yoke 1 is supported by the opposing faces of the retaining elements 2*b*' and 2*b*" of the distal end bifurcated portion of the housing 2, a guide 9 is fitted in a circular hole formed in the retaining element 2*b*" of the distal end bifurcated portion, and a hole snap ring 10 is attached so that the small diameter portion 3*b* of the spindle 3 is supported by the guide 9. Springs 11 and balls 12 are housed in two or three holes provided so as to be equidistantly spaced in a circle at the step end face of the small diameter portion 3*b* and large diameter portion 3*c* of the spindle 3, and the balls 12 are pushed into the guide 9, thus creating a braking force that brakes the free rotation of the spindle 3. Also, the large diameter portion 3*c* of the spindle 3 is supported while being pressed by a guide 13 that serves as a spring seat, thereby causing the spindle 3 to function as a support shaft for the yoke 1.

The motion converter 7 for converting rotary motion into reciprocal swing motion comprises an eccentric shaft 7*a* integrally provided at the distal end of the power transmission shaft 6, a ball 7*b* into which the eccentric shaft 7*a* is fitted, and a recess 7*c* formed in a jutting portion of the proximal side of the yoke 1 and in which the ball 7*b* is engaged.

The above-described power ratchet wrench, however, has drawbacks.

(1) When a bolt is being fastened tightly, or when a tightly fastened bolt is being loosened, the yoke 1 hits the retaining elements 2*b*' and 2*b*" of the distal end bifurcated portion of the housing 2 while rotating. The inventors discovered the following as a result of investigating this mechanism.

The inside periphery of the internal teeth 1*a* of the yoke 1 is supported by the large diameter portion 3*c* of the spindle 3, and thus, the internal teeth 1*a* of the yoke 1 are inherently worn out quickly. Furthermore, right from the outset there is a large clearance between the large diameter portion 3*c* of the spindle 3 and the diameter of the internal teeth 1*a* of the yoke 1, and this clearance grows even larger if the internal teeth 1*a* of the yoke 1 wears out quickly.

There is also a clearance between the yoke 1 and the retaining elements 2*b*' and 2*b*" of the distal end bifurcated portion of the housing 2.

Therefore, when the ball 7*b* engages the recess 7*c* of the yoke 1 and undergoes planetary rotation that causes the yoke 1 to pivot, the rotational center of the yoke 1 will be greatly shifted with respect to the spindle 3, and the rotational center will also be tilted as the yoke 1 rotate. It is even possible that the yoke 1 tilts around a line perpendicular to both the rotational center of the spindle 3 and the centerline of the ratchet.

The run-out of the yoke 1 when a bolt was being tightened was examined by photography with a high-speed video camera. The examination shows that every time the ball 7*b* undergoes one planetary rotation, the yoke 1 tilts around a line perpendicular to both the rotational center of the spindle 3 and the center line of the ratchet, then returns, tilts again, returns, and this is repeated.

The yoke 1 hits the retaining elements 2*b*' and 2*b*" of the distal end bifurcated portion of the housing 2 while rotating.

The reason found for this is that the cycle in which the yoke 1 tilts around a line perpendicular to both the rotational center of the spindle 3 and the center line of the ratchet, returns, tilts, and then returns is repeated over and over at high speed, and the yoke 1 repeatedly exerts a wedge action that spreads open the gap between the retaining elements 2*b*' and 2*b*" of the distal end bifurcated portion.

(2) The function whereby the yoke 1 rotates the spindle 3 in steps becomes unreliable, and it shortens the useful life of the product. The inventors discovered the following as a result of investigation of this shortened product service life.

Very slight vibrations occur between the yoke 1, the spindle 3 and the ratchet mechanism 8, causing repeated impacts of the internal teeth 1*a* of the yoke 1 against the large diameter portion 3*c* of the spindle 3. Over time, and within a relatively short time of use, the smooth peripheral surface of the large diameter portion 3*c* of the spindle 3 becomes uneven, and wear and deformation of the tips of the internal teeth 1*a* of the yoke 1 are also accelerated. As the unevenness become more pronounced and the wear and deformation proceed, the ratchet pawl 8*a* no longer meshes at the proper location on the internal teeth 1*a* of the yoke 1, the meshing operation for stepping becomes unreliable, and it becomes impossible to turn bolts and the like properly.

As discussed above, in the conventional ratchet, the inside diameter of the internal teeth 1*a* of the yoke 1 is supported by the large diameter portion 3*c* of the spindle 3, and the yoke 1 is subjected to twisting that results from the repeated tilting back and forth while it rotate. Consequently, the yoke 1 hits the retaining elements 2*b*' and 2*b*" of the distal end bifurcated portion of the housing 2 during rotation, thus repeatedly exerting a wedge action that spreads open the gap between the retaining elements 2*b*' and 2*b*" of the distal end bifurcated portion. As a result, the retaining elements 2*b*' and 2*b*" of the distal end bifurcated portion spread apart, and their clearance from the yoke 1 increases faster than it would otherwise.

In other words, the ratchet pawl 8*a* becomes no longer to mesh at a proper location on the internal teeth 1*a* of the yoke 1, the meshing operating for stepping motion becomes unreliable, and thus the bolt and the like cannot be turned properly. These are caused in large part by the fact that the retaining elements 2*b*' and 2*b*" of the distal end bifurcated portion are spread apart and the clearance between them and the yoke 1 increases faster that it would otherwise.

The inventors examined the spring 8*d* of the ratchet mechanism 8 by way of using many springs with three different characteristics: wire diameter, winding pitch, and spring length. The springs were installed in the ratchet mechanism 8, beginning with the weakest one and then those having a higher strength. It was found that if the spring is too weak, the meshing of the ratchet pawl 8*a* with the internal teeth 1*a* of the yoke 1 becomes misaligned, so that the stepping motion becomes unreliable, sometimes occurring and sometimes not. In contrast, if the spring is too strong, the ratchet pawl 8*a* remain meshed at the same location without any changes in the meshing position with the internal teeth 1*a* of the yoke 1, and it does not occur that the ratchet pawl 8*a* follows the reciprocal rotating motion of the yoke 1, and the spindle 3 follows the rotation of the ratchet pawl; as a result, the spindle does not make a stepwise rotation.

The inventors also examined the braking force that restricts the free rotation of the spindle 3.

The springs 11 were examined by way of using many springs with three different characteristics: wire diameter, winding pitch, and spring length. These springs were installed in the spindle, beginning with the weakest ones and then those having a higher strength. As a result, it was found that if the spring 11 is too weak, there is too little braking force exerted on the free rotation of the spindle 3. If the spring 11 is too strong, the same phenomenon as the strong spring 8*d* occurs. In other words, the ratchet pawl 8*a* remains meshed at the same location without any changes in the meshing position with the internal teeth 1*a* of the yoke 1. Thus, it does not occur that the ratchet pawl 8*a* follows the reciprocal rotating motion of the yoke 1, and the spindle 3 follows the rotation of the ratchet pawl; as a result, the spindle does not make a stepwise rotation.

It was found that when the strong springs 11 are used and the braking force exerted on the free rotation of the spindle 3 is increased such that the spindle 3 can be halted when the yoke 1 rotates in the direction opposite from the direction in which the spindle 3 is rotated turn stepwise, then the ratchet pawl 8*a* can properly escape from the yoke 1 of the yoke 1; and during the next rotation of the yoke 1 in the direction in which the spindle 3 is rotated in steps, the ratchet pawl 8*a* meshes with the internal teeth 1*a* of the yoke 1 and renders the spindle 3 to make a stepwise rotation.

However, if the distal end bifurcated portion is spread apart, and the clearance of its retaining elements 2*b*' and 2*b*" from the yoke 1 increases sooner than it would be otherwise, then the same result occurs as when the springs 11 are weak and a lower the braking force exerts on the free rotation of the spindle 3. This was found to be what shortens the service life of conventional ratchets.

(3) The housing 2 must be made from thick steel or iron that is annealed in order to make the housing 2 strong enough so that the distal end bifurcated portion (or the retaining elements 2*b*' and 2*b*") will not spread apart, and this makes the distal ends of the housing 2 heavier. However, such a housing places a greater load on the user's arm when the wrench is used for extended periods, making the tool less convenient to use. Furthermore, even if the housing 2 is made from thick steel or iron that is annealed, the distal end bifurcated portion tends to open up (or the distance between its retaining elements 2*b*' and 2*b*" increases) within a relatively short period of time, making the function of the ratchet pawl 8*a* that rotates the spindle 3 in steps unreliable.

(4) The motion converter 7, that includes the eccentric shaft 7*a*, the ball 7*b* and the recess 7*c*, is provided next to the yoke 1; and the shape of the housing 2 bulges significantly. As a result, the distal end bifurcated portion (particularly its retaining elements 2*b*' and 2*b*") cannot be seen during the turning of a bolt and the like in a deeply recessed location, making it more difficult for users to see if the workpiece engagement portion 3*a* of the spindle 3 is engaged with the bolt, nut, screw or other workpiece.

SUMMARY OF THE INVENTION

Accordingly, the first object of the present invention is to provide a power ratchet wrench wherein a structure in which the internal teeth of the yoke are supported by the large diameter portion of a spindle is eliminated, thus making it less likely that whirling occurs in the yoke, and the internal teeth of the yoke is prevented from hitting the peripheral surface of the large diameter portion of the spindle. The early wear and deformation of the tips of the internal teeth of the yoke is thus avoided, assuring that the ratchet pawl meshes with the internal teeth of the yoke and perform its stepping operation for a longer period, allowing bolts and so forth to be turned properly for a longer period. Also, in the present invention, twisting of the yoke due to the friction with motion converter during the rotation of the yoke is less likely to occur, and the force that would spread open the distal end bifurcated portion of the housing is greatly reduced. Thus, the distal end bifurcated portion of the housing is formed strong enough even if made from an aluminum alloy or the like and can be made thinner, thus greatly reducing the weight at the distal end. Accordingly, the load on the user's arm when the wrench is being used for an extended period is reduced, making the wrench more convenient to use. Moreover, in the present invention, the proximal end next to the distal end bifurcated portion of the housing is formed smaller in diameter than the distal end bifurcated portion. Thus, it is easier in the present invention to see that the workpiece engagement portion which is at the distal end of the spindle is engaged with a bolt and other workpiece, thus making the wrench even more convenient to use.

The second object of the present invention is to provide a power ratchet wrench wherein a structure in which the internal teeth of the yoke are supported by the large diameter portion of a spindle is eliminated, thus making it less likely that whirling occurs in the yoke, and the internal teeth of the yoke is prevented from hitting the peripheral surface of the large diameter portion of the spindle. The early wear and deformation of the tips of the internal teeth of the yoke is thus avoided, assuring that the ratchet pawl meshes with the internal teeth of the yoke and perform its stepping operation for a longer period, allowing bolts and so forth to be turned properly for a longer period. Also, in the present invention, twisting of the yoke due to the friction with motion converter during the rotation of the yoke is less likely to occur, and the force that attempts to spread open the distal end bifurcated portion of the housing is greatly reduced. Thus, the distal end bifurcated portion of the housing is formed strong enough even if made from an aluminum alloy or the like and can be made thinner, thus greatly reducing the weight at the distal end. Accordingly, the load on the user's arm when the wrench is being used for an extended period is reduced, making the wrench more convenient to use.

The first object is accomplished by a unique structure for a power ratchet wrench of the present invention that comprises:

a housing having a distal end bifurcated portion, a yoke provided in the bifurcated portion, and a spindle inserted inside the yoke and having a workpiece engagement portion, a small diameter portion, and a large diameter portion, wherein a rotary motion of a motor provided on a proximal side of the housing is transmitted through a motion converter that converts a rotary motion into a reciprocal swing motion, thereby reciprocally rotating the yoke by way of using a center line of the spindle as a center of a rotational-motion thereof, so that a ratchet pawl of a ratchet mechanism installed in a space inside the large diameter portion of the spindle is alternately engaged and disengaged from an internal teeth formed around an inner peripheral surface of a hole of the yoke, thus causing the spindle to rotate in steps and causing a workpiece, such as a bolt, nut, screw, and the like, to turn with a workpiece engagement portion provided at one end of the spindle, and in the power ratchet wrench of the present invention:

the yoke is structured such that the internal teeth are recessed from an end face thereof, guide bushings fitted and fixed in the distal end bifurcated portion of the housing are inserted in the hole of the yoke and support the yoke at both ends thereof, the spindle is inserted and a protruding member is provided to keep the spindle from being pulled out, and the spindle is supported at both ends of the spindle by the guide bushings, the housing has a small-diameter middle section that is from the distal end bifurcated portion to about halfway toward the proximal side of the and has an external shape narrower than the distal end bifurcated portion so that the distal end bifurcated portion can be seen from the proximal side, and the motion converter is comprised of:

a swing lever which is provided in an internal space of the small-diameter middle section of the housing, a boss which is provided at an approximate middle point of the swing lever and is rotatably disposed on a pivot shaft which is provided in the small-diameter middle section of the housing so as to be parallel to the spindle, an engagement portion which is provided at one end of the swing lever and has a groove-shaped recess formed at a proximal end of the swing lever, the groove-shaped recess fitting on a ball provided on an eccentric shaft of a speed-reduction assembly provided in the housing, and a cylindrical portion which is formed at another end of the swing lever and is slidably engaged with a U-shaped groove formed in a jutting portion of a proximal side of the yoke.

The second object is accomplished by another unique structure for a power ratchet wrench of the present invention that comprises:

a housing having a distal end bifurcated portion, a yoke provided in the bifurcated portion, and a spindle inserted inside the yoke and having a workpiece engagement portion, a small diameter portion, and a large diameter portion, wherein a rotary motion of a motor provided on a proximal side of the housing is transmitted through a motion converter that converts a rotary motion into a reciprocal swing motion, thereby reciprocally rotating the yoke by way of using a center line of the spindle as a center of a rotational-motion thereof, so that a ratchet pawl of a ratchet mechanism installed in a space inside the large diameter portion of the spindle alternately is engaged with and disengaged from an internal teeth formed around an inner peripheral surface of a hole of the yoke, thus causing the spindle to rotate in steps and causing a workpiece, such as a bolt, nut, screw, and the like, to turn with a workpiece engagement portion provided at one end of the spindle, and in the power ratchet wrench of the present invention:

the yoke is structured such that the internal teeth are recessed from an end face thereof, guide bushings fitted and fixed in the distal end bifurcated portion of the housing are inserted in the hole of the yoke and support the yoke at both ends thereof, the spindle is inserted and a protruding member is provided to keep the spindle from being pulled out, and the spindle is supported at both ends of the spindle by the guide bushings.

DETAILED DESCRIPTION OF THE INVENTION

Figure 1:
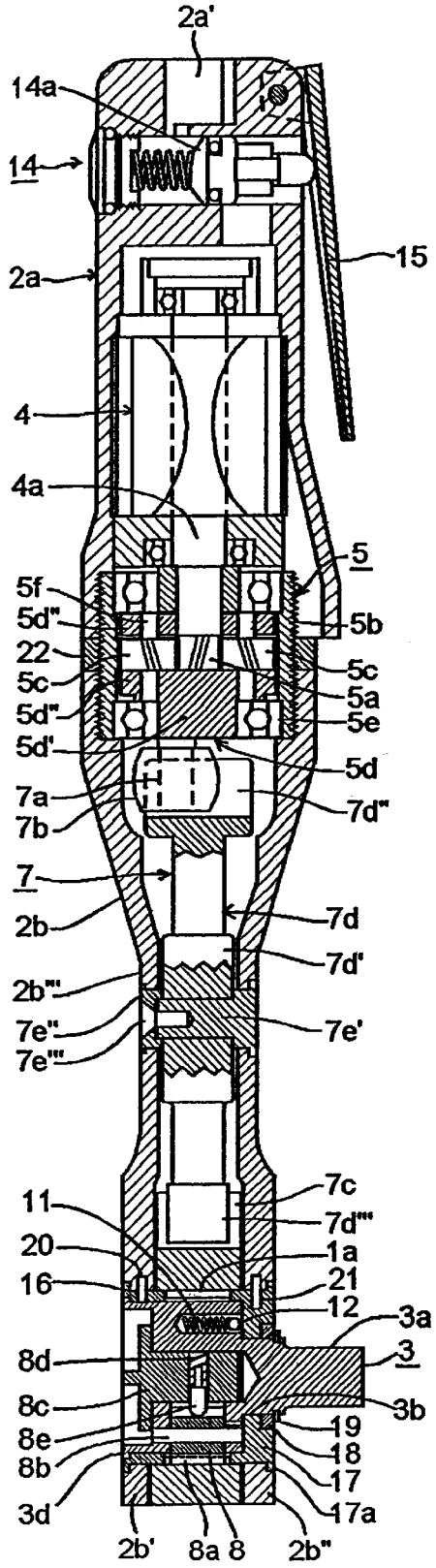
FIG. 1 is an overall vertical cross sectional side view of the power ratchet wrench according to the first embodiment of the present invention.
Figure 2:
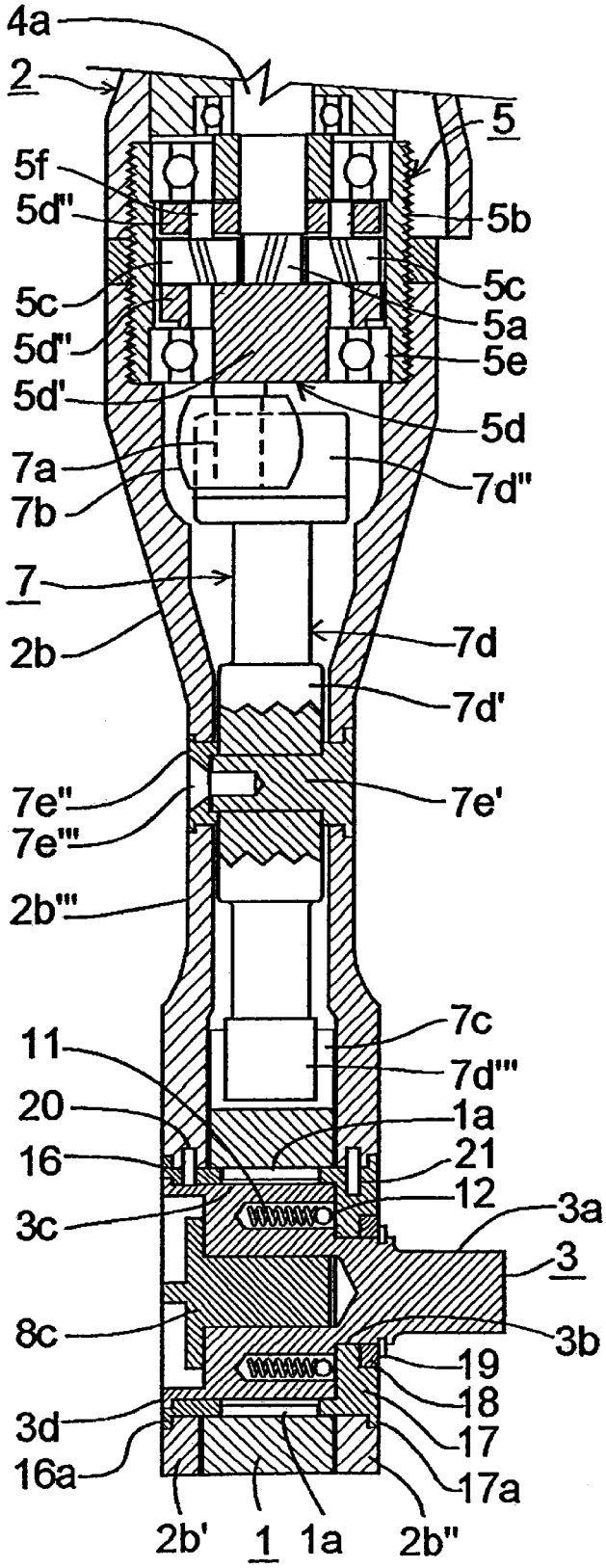
FIG. 2 is an enlarged vertical cross section side view of the distal end portion of the ratchet wrench in a different state from FIG. 1 (in which the spindle is rotated in FIG. 2)
Figure 3:
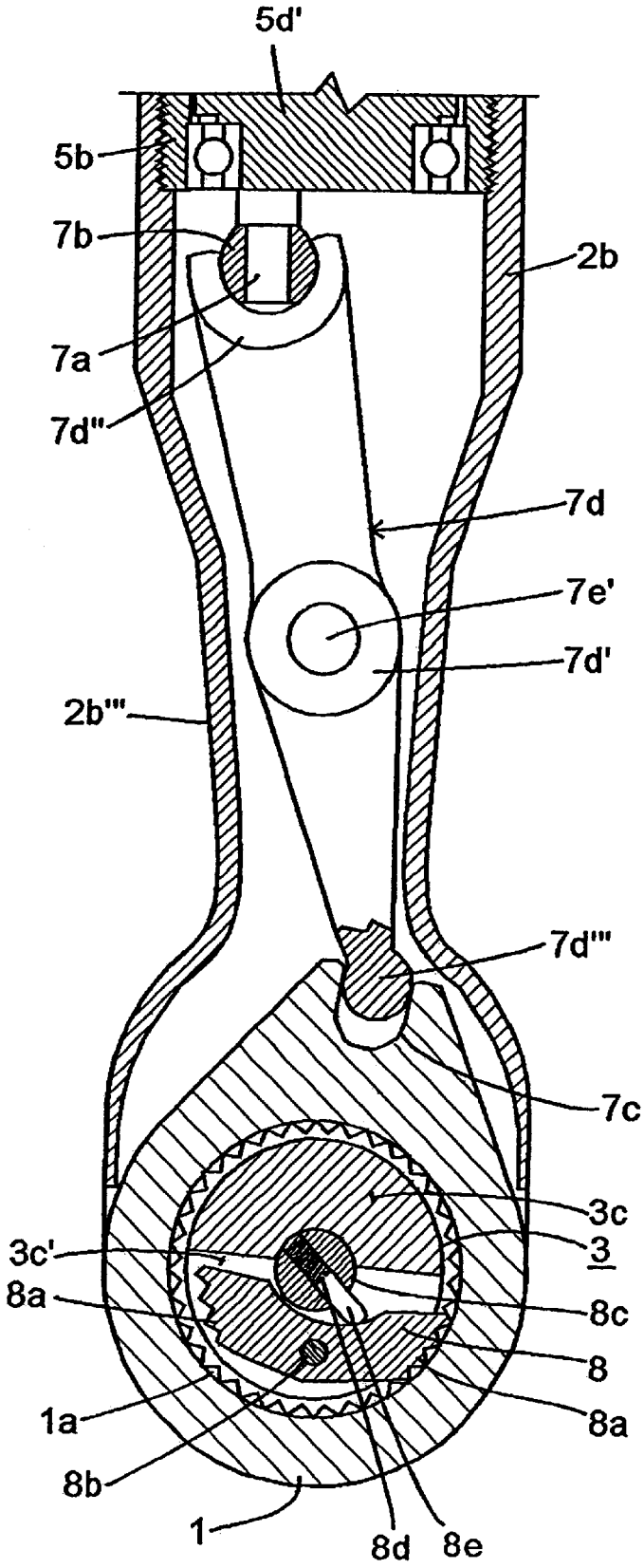
FIG. 3 is an enlarged vertical cross section front view of the distal end portion of the ratchet wrench.

The power ratchet wrench according to the first embodiment of the present invention will be described with reference to FIGS. 1 through 3.

The housing 2 of the power ratchet wrench of this embodiment is split into two: a proximal end housing 2*a* and a distal end housing 2*b*.

The proximal end housing 2*a* has a hollow shape and includes a pressurized air inlet, a valve compartment, a motor compartment, and a speed-reduction assembly compartment (none of which is numbered). A valve assembly 14 is provided in the valve compartment, an air motor 4 is provided in the motor compartment, and half of the planet gear speed-reduction assembly 5 is disposed in the speed-reduction assembly compartment. A lever 15 that opens a valve body 14*a* of the valve assembly 14 is pivotally mounted outside the proximate end housing 2*a*.

The distal end housing 2*b* also has a hollow shape and includes a speed-reduction assembly compartment and a motion converter compartment (none of which is numbered). Half of the planet gear speed-reduction assembly 5 is disposed in the motion converter compartment; and a motion converter 7, which converts a rotary motion into a swing motion, is provided in the motion converter compartment. The distal end housing 2*b* further includes, in its distal end bifurcated portion that comprises retaining elements 2*b*' and 2*b*", a spindle 3, a ratchet mechanism 8, guide bushings 16 and 17, etc.

External threads are formed on the outer peripheral surface of an internal tooth ring gear 5*b* of the planet gear speed-reduction assembly 5. The proximal end housing 2*a*, a lock nut 22, and the distal end housing 2*b* are threaded together on this outer peripheral surface of the internal tooth ring gear 5*b* of the planet gear speed-reduction assembly 5.

The reference numeral 2*a*' is a pressurized air inlet. When a high-pressure air supply hose for a compressor is connected to the pressurized air inlet 2*a*', and the lever 15 is operated, the valve body 14*a* of the valve assembly 14 is opened. High-pressure air is, as a result, supplied into the air motor 4, and the air motor 4 rotates.

Since the structure in which the valve body 14*a* of the valve assembly 14 is opened when the lever 15 is pulled is known, no detailed description thereon is provided here. The motor can be an electric motor instead of an air motor. With a use of an electric motor, the lever 15 and the valve assembly 14 are not required.

The planet gear speed-reduction assembly 5 serves to increase the torque by reducing the rotational speed, and it comprises a sun gear 5*a*, an internal tooth ring gear 5*b*, planet gears 5*c*, and an output shaft 5*d*.

The sun gear 5*a* is integrally formed at the end of a rotor 4*a* of the air motor 4. The internal tooth ring gear 5*b*, which is not rotatable, is provided on the outside of the sun gear 5*a*. The planet gears 5*c* rotate by meshing with the sun gear 5*a* and the internal tooth ring gear 5*b*. The output shaft 5*d* is comprised of a small diameter portion 5*d*' and a large diameter portion 5*d*". The small diameter portion 5*d*' that is on the distal end side is supported by a bearing 5*e*. The sun gear 5*a* and the planet gears 5*c* are received in a space made in the large diameter portion 5*d*" that is on the proximal side. The output shaft 5*d* supports the both ends of each of pins 5*f* that rotatably support the planet gears 5*c*.

When the sun gear 5*a* is rotated, the planet gears 5*c* revolve on their own axes and also undergo planetary rotation, and the output shaft 5*d* is rotated by the planetary rotation of the planet gears 5*c*.

The speed-reduction assembly 5 is not limited to that described above. Also, the speed-reduction assembly can be omitted. Furthermore, a hammer structure that imparts hammer rotation, as employed in the power ratchet wrench in Japanese Patent Application Publication (Kokoku) H6-35115, can be used instead of the speed-reduction assembly 5.

The particular structure of the first embodiment is that the yoke 1 has a large diameter hole portion at its both ends and a small diameter hole portion in the middle. An internal teeth 1*a* are formed in the small diameter hole portion, and the internal teeth 1*a* of the yoke 1 are thus recessed from the end faces. Spindle insertion spaces are formed in both retaining elements 2*b*' and 2*b*" of the distal end bifurcated portion, and guide bushings 16 and 17 are fitted in the large diameter hole portions at both ends of the yoke 1 and fixed by pins 20 and 21. As a result, the guide bushings 16 and 17 support the yoke 1 at both ends of the yoke 1, and the yoke 1 is supported so that its rotation accompanies no lateral shift.

The spindle 3 is inserted form the outside into one of the guide bushings 16, thus allowing the workpiece engagement portion 3*a* of the spindle 3 to protrude from the other guide bushing 17. The flange 3*d* of the spindle 3 is fitted to the recessed surface of the guide bushing 16, and the step end face between the small diameter portion 3*b* and large diameter portion 3*c* of the spindle 3 is fitted to the inner end face of the other guide bushing 17.

Springs 11 and balls 12 are accommodated in two or three holes provided so as to be equidistantly spaced in circle in the step end face between the small diameter portion 3*b* and large diameter portion 3*c* of the spindle 3. The balls 12 push on the guide bushing 17 and brake the free rotation of the spindle 3.

The spindle 3 is prevented from being pulled out by a protruding member (a thickness adjusting disk 18 and shaft snap ring 19) provided in the small diameter portion 3*b* of the spindle 3. The small diameter portion 3*b* is supported by the guide bushing 17, while the large diameter portion 3*c* is supported by the guide bushing 16, so that the spindle 3 is supported at both ends by the guide bushings 16 and 17, assuring that the spindle 3 is rotated with no lateral shift accompanied. Thus, the yoke 1 and the spindle 3 are both supported at both ends by the guide bushings 16 and 17, and the internal teeth 1*a* of the yoke 1 are not supported by the large diameter portion 3*c* of the spindle 3.

Therefore, in the above structure, if a small clearance is provided between the yoke 1 and each one of the retaining elements 2*b*' and 2*b*" of the distal end bifurcated portion, the opposing faces of the retaining elements 2*b*' and 2*b*" of the distal end bifurcated portion make a sliding contact with the end faces of the yoke 1 and support the end faces of the yoke 1; but if a large clearance is provided, then there is no sliding contact between the retaining elements 2*b*' and 2*b*" of the distal end bifurcated portion and the end faces of the yoke 1.

Figure 5:
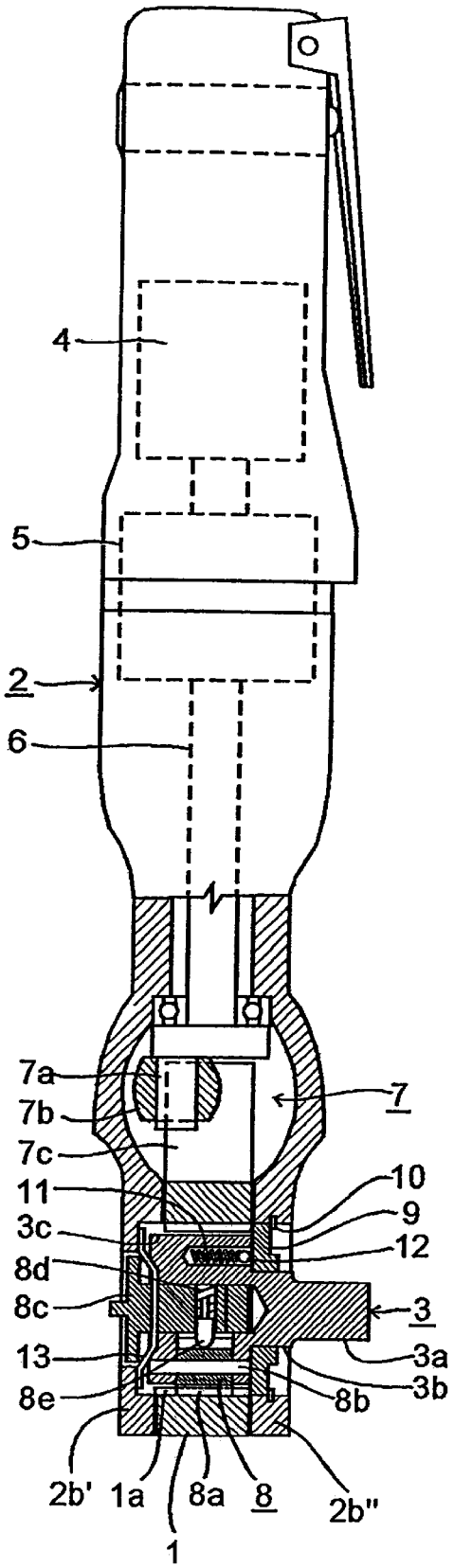
FIG. 5 PRIOR ART
FIG. 5 is an overall vertical cross section side view of a conventional power ratchet wrench.

The springs 11 and the balls 12 can be omitted, so that the braking force on the spindle 3 is instead obtained ensured by providing the guide 13 shown in FIG. 5.

The outer portion of the housing 2 that corresponds to the area between the yoke 1 and the speed-reduction assembly 5 of the distal end housing 2*b* is a middle section 2*b*"", and this middle section 2*b*"" is formed narrower than the distal end bifurcated portion so that the distal end bifurcated portion can be seen from the proximal side.

The motion converter 7 provided in the housing 2 has a swing lever 7*d* that is installed inside the small diameter section 2*b*"" of the distal end housing 2*b*. A boss 7*d*' at an approximate middle portion of the swing lever 7*d* passes through a pivot shaft 7*e*' that is provided parallel to the spindle 3. A pivot shaft 7*e*' is fitted in a bushing 7*e*", and a screw 7*e*"" is connected to the pivot shaft 7*e*' and is tightened. Thus, the boss 7*d*' of the swing lever 7*d* is prevented from being moved even slightly in its axial direction. The swing lever 7*d* further has an engagement portion 7*d*" that is formed at its proximal end and has a groove-shaped recess. This groove-shaped recess fits on and engages a ball 7*b* that is provided on an eccentric shaft 7*a* that extends from the distal end of the output shaft 5*d* of the speed-reduction assembly 5. Furthermore, the swing lever 7*d* has, at its distal end, a cylindrical portion 7*d*"". The cylindrical portion 7*d*"" is slidably engaged with a U-shaped groove 7*c* formed in a jutting portion of the proximal side of the yoke 1.

Thus, the rotation outputted by the output shaft 5*d* of the speed-reduction assembly 5 is transmitted through the eccentric shaft 7*a* and the ball 7*b* to the swing lever 7*d*, thus being converted into a swing motion of the swing lever 7*d*. This swing motion of the swing lever 7*d* is transmitted so as to rotate the yoke 1 back and forth.

The ball 7*b* exerts a frictional force on the engagement portion 7*d*" in the direction perpendicular to the swing plane of the swing lever 7*d*. However, the boss 7*d*' of the swing lever 7*d* is supported by the pivot shaft 7*e*', the boss 7*d*' is sandwiched by the pivot shaft 7*e*' and the bushing 7*e*", and thus the swing lever 7*d* is restricted so as to make only a swing motion. Accordingly, almost no force that would twist the yoke 1 is exerted on the transmission of motion from the swing lever 7*d* to the yoke 1; and therefore, the yoke 1 is not subjected to any force that would spread open the gap between the retaining elements 2*b*' and 2*b*" of the distal end bifurcated portion of the distal end housing 2*b*.

If there should happen to be any rotation that is accompanied by twisting in the yoke 1, the force that attempts to open up the distal end bifurcated portion (or its retaining elements 2*b*' and 2*b*") will be received by the guide bushings 16 and 17, and such a force will be further received by the shaft snap ring 19 and the flange 3*d* of the spindle 3. Accordingly, the distal end bifurcated portion is prevented from being opened (or the distance of its retaining elements 2*b*' and 2*b*" is prevented from increasing).

Also, if the workpiece engagement portion 3*a* of the spindle 3 should be subjected to a powerful blow due to, for instance, the ratchet wrench being accidentally dropped, the force of this blow will be received by the distal end bifurcated portion through the shaft snap ring 19, the thickness adjusting disk 18, and the guide bushing 17. Accordingly, even in a case of such a powerful blow, the distal end bifurcated portion will still not open up (or the distance of its retaining elements 2*b*' and 2*b*" is prevented from increasing).

Accordingly, the distal end housing 2*b* can be made from a lightweight metal material such as an aluminum alloy or from a strong plastic material or the like.

The ratchet pawl 8*a* of the ratchet mechanism 8 installed inside the space made in the large diameter portion 3*c* of the spindle 3 is alternately engaged with and disengaged from the internal teeth 1*a* formed around the inner peripheral surface of the hole in the yoke 1. The spindle 3 is thus rotated in steps.

More specifically, the ratchet mechanism 8 comprises the ratchet pawl 8*a*, the pin shaft 8*b* on which the ratchet pawl 8*a* pivots at its central portion, the knob shaft 8*c* that is inserted into a hole made in the end face on the large diameter portion 3*c* side of the spindle 3, the spring 8*d* installed in a side hole made in the knob shaft 8*c*, and a push pin 8*e* that is biased by the spring 8*d* so as to be pressed into a recess of the back side of the ratchet pawl 8*a*.

With this structure, the location where the push pin 8*e* presses can be changed by twisting the knob shaft 8*c* to the right or left. When the knob shaft 8*c* is twisted to the right in FIG. 3, the right-hand portion of the ratchet pawl 8*a* is alternately engaged with and disengaged from the internal teeth 1*a* of the yoke 1. As a result, the spindle 3 is rotated in steps to the right (clockwise). When the knob shaft 8*c* is twisted to the left in FIG. 3, then the left-hand portion of the ratchet pawl 8*a* is alternately engaged with and disengaged from the internal teeth 1*a* of the yoke 1. As a result, the spindle 3 is rotated in steps to the left (counter-clockwise). Accordingly, a workpiece such as a bolt, nut, and screw (not shown) are turned by the workpiece engagement portion 3*a* provided at one end of the spindle 3.

The ratchet pawl 8*a* may instead provided at locations that differ by 180 degrees on the knob shaft 8*c*.

As seen from above, in the ratchet wrench, almost no force is exerted that would tend to open up the distal end bifurcated portion of the distal end housing 2*b*. Accordingly, the distal end housing 2*b* can be made from an aluminum alloy or the like. Also, the distal end bifurcated portion (in other words, its retaining elements 2*b*' and 2*b*") can be made thinner compared to the existing wrenches.

Figure 4:
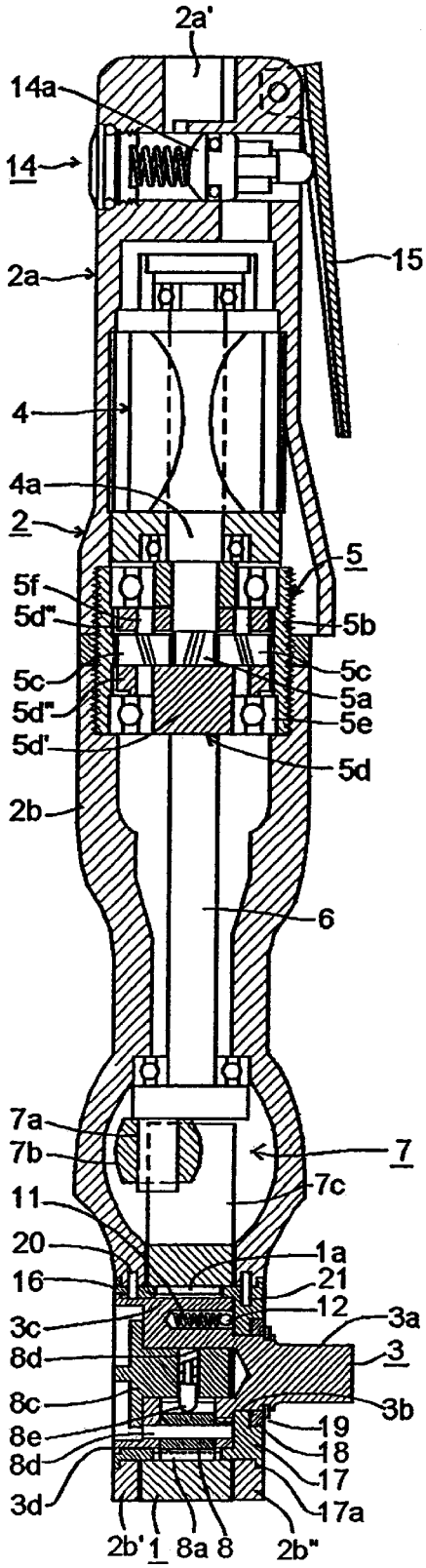
FIG. 4 is an overall vertical cross section side view of the power ratchet wrench according to the second embodiment of the present invention.

FIG. 4 illustrates the power ratchet wrench according to the second embodiment of the present invention. The ratchet wrench of FIG. 4 includes the motion converter 7 that converts a rotary motion to a reciprocal swing motion in the same manner as in the conventional wrench shown in FIG. 5.

The motion converter 7 comprises an eccentric shaft 7*a* integrally provided at the distal end of the power transmission shaft 6, a ball 7*b* into which the eccentric shaft 7*a* is fitted, and a recess 7*c* formed in a jutting portion of the proximal side of the yoke 1 and in which the ball 7*b* is engaged.

In the wrench of FIG. 4, the motion converter 7 is structured in the same manner as in the conventional wrench. However, the yoke 1 and spindle 3 installed in the distal end bifurcated portion of the distal end housing 2*b* are different from the conventional ratchet wrench in which the inside diameter of the internal teeth of the yoke is supported by the large diameter portion of the spindle. In the structure of FIG. 4, the yoke 1 and the spindle 3 are each supported at both ends thereof by the guide bushings 16 and 17 as in the first embodiment.

Accordingly, if a force is exerted that would tend to open up the distal end bifurcated portion (or to increase the distance between the retaining elements 2*b*' and 2*b*" thereof) due to twisting that would occur when the yoke 1 is rotated, this force is received by the guide bushings 16 and 17 and is further received by the shaft snap ring 19 and the flange 3*d* of the spindle 3. Accordingly, the distal end bifurcated portion is not opened up. Also, because the inside diameter of the internal teeth 1*a* of the yoke 1 is not supported by the large diameter portion 3*c* of the spindle 3, the premature wear of the internal teeth 1*a* of the yoke 1 is avoided; and furthermore, even if there is at the outset a large clearance between the inside diameter of the internal teeth 1*a* of the yoke 1 and the large diameter portion 3*c* of the spindle 3, this clearance does not affect the whirling of the yoke 1.

The rest of the parts of the wrench of FIG. 4 are the same as in the first embodiment and therefore referred to by the same reference numbers but not described here.

As seen from the above, compared to the conventional power ratchet wrench, in the power ratchet wrench of the first embodiment of the present invention, the internal teeth of the yoke are prohibited from hitting the peripheral surface of the large diameter portion of the spindle, wear and deformation of the tips of the internal teeth of the yoke are thus reduced, and the meshed stepping motion of the ratchet pawl with the internal teeth of the yoke can be assured for an extended period. Also, twisting of the yoke is kept to a minimum, which greatly reduces the force that would tend to open up the distal end bifurcated portion of the housing, and the housing can be made from an aluminum alloy or the like and be more lightweight. Furthermore, since the distal end of the housing next to the distal end bifurcated portion is formed narrower, it is easier to see that the workpiece engagement portion of the spindle is engaged with a bolt and other workpiece in a deeply recessed location. Thus, the wrench is easy to use.

More specifically, compared to the conventional power ratchet wrench, the power ratchet wrench of the first embodiment is structured so that the internal teeth of the yoke are not supported by the large diameter portion of the spindle, and instead the yoke and spindle are each independently and rotatably supported at both ends thereof by the guide bushings located on either side. Also, the guide bushings on both sides are fitted from the outside so that the distal end bifurcated portion of the housing does not open up, the spindle is inserted, and the shaft snap ring is fitted, thus preventing the guide bushings from coming apart. Furthermore, the motion converter that has a swing lever is provided, so that almost no twisting force is exerted on the yoke. Thus, the yoke undergoes no whirling, and the hitting of the internal teeth of the yoke against the peripheral surface of the large diameter portion of the spindle is prevented. Also, the development of unevenness on the peripheral surface of the large diameter portion of the spindle is prevented, and the premature wear and deformation of the tips of the internal teeth of the yoke is prevented. Consequently, the meshed stepping motion of the ratchet pawl with the internal teeth of the yoke can be assured over an extended period, and bolts and other workpiece can be turned properly for a longer period.

Also, in cases that the swing lever is subjected to twisting, even slightly, due to friction between the swing lever and the ball, and a twisting force (that is, a wedge action that opens up the distal end bifurcated portion) is exerted on the yoke during its rotation, the twisting force the yoke is subjected is received by the guide bushings fitted on either side of the yoke and is further received by the shaft snap ring and the flange of the spindle. Accordingly, the wedge action force received by the opposing faces of the distal end bifurcated portion of the housing can be greatly reduced. This means that the distal end bifurcated portion of the housing is strong enough so that they can be made from an aluminum alloy or the like; and further, the thickness can be reduced, which makes the distal end much lighter, lessens the load on the user's arm when the tool is being used for an extended period. Thus, the wrench is high in convenience to use.

Moreover, the proximal end next to the distal end bifurcated portion of the housing is smaller in diameter than the distal end bifurcated portion. Thus, it is easier to see that the workpiece engagement portion at the end of the spindle is engaged with a bolt and other workpiece. In this aspect as well, the wrench significantly convenient to use.

Furthermore, compared to the conventional power ratchet wrench, in the power ratchet wrench of the second embodiment of the present invention, the internal teeth of the yoke are prohibited from hitting the peripheral surface of the large diameter portion of the spindle, wear and deformation of the tips of the internal teeth of the yoke are thus reduced, and the meshed stepping motion of the ratchet pawl with the internal teeth of the yoke can be assured for an extended period. Also, twisting of the yoke is kept to a minimum, which greatly reduces the force that would tend to open up the distal end bifurcated portion of the housing, and the housing can be made from an aluminum alloy or the like and be more lightweight. Thus, the wrench is easy to use.

More specifically, compared to the conventional power ratchet wrench, the power ratchet wrench of the first embodiment is structured so that the internal teeth of the yoke are not supported by the large diameter portion of the spindle, and instead the yoke and spindle are each independently and rotatably supported at both ends thereof by the guide bushings located on either side. Also, the guide bushings on both sides are fitted from the outside so that the distal end bifurcated portion of the housing does not open up, the spindle is inserted, and the shaft snap ring is fitted, thus preventing the guide bushings from coming apart, and thus the hitting of the internal teeth of the yoke against the peripheral surface of the large diameter portion of the spindle is prevented. Also, the development of unevenness on the peripheral surface of the large diameter portion of the spindle is prevented, and the premature wear and deformation of the tips of the internal teeth of the yoke is prevented. Consequently, the meshed stepping motion of the ratchet pawl with the internal teeth of the yoke can be assured over an extended period, and bolts and other workpiece can be turned properly for a longer period.

Also, though a twisting force (that is, a wedge action that opens up the distal end bifurcated portion) is exerted on the yoke due to friction between the swing lever and the ball, the twisting force to which the yoke is subjected is received by the guide bushings fitted on either side of the yoke and is further received by the shaft snap ring and the flange of the spindle. Accordingly, the wedge action force received by the opposing faces of the distal end bifurcated portion of the housing can be greatly reduced. This means that the distal end bifurcated portion of the housing is strong enough so that they can be made from an aluminum alloy or the like; and further, the thickness can be reduced, which makes the distal end much lighter, lessens the load on the user's arm when the tool is being used for an extended period. Thus, the wrench is high in convenience to use.

What is claim is:

1. A power ratchet wrench comprising:

a housing (2);

a yoke (1) installed between retaining elements (2*b*', 2*b*") fanned in a distal end bifurcated portion of said housing (2), said yoke (1) having large diameter hole portions on both ends thereof, a small diameter hole portion between said large diameter hole portions, and internal teeth (1*a*) formed on an inner peripheral surface of said small diameter hole portion;

guide bushings (16, 17) that have flanges and are fitted, from both outsides, into a guide bushing compartment which is formed in said distal end bifurcated portion of said housing (2) and has large diameter hole portions an outer sides thereof and a small diameter portion on an inner side thereof, so that inner ends of said guide bushings (16, 17) are fitted in said large diameter hole portions of said yoke (1), said guide bushings (16, 17) being connected to said retaining elements (2*b*', 2*b*") by pins (20, 21) respectively so that said yoke (1) is supported at both ends thereof by said guide bushings (16, 17) and a center of rotational-motion of said yoke (1) coincides with a center of a distance between said guide bushings (16, 17), and inner end faces of said guide bushings (16, 17) being disposed close to step end faces of said large diameter hole portions and small diameter hole portion of said yoke (1) with spaces in between so that both surfaces of said yoke (1) is prevented from making close contact wit said retaining elements (2*b*', 2*b*");

a spindle (3) composed of a workpiece engagement portion (3*a*), a small diameter portion (3*b*) and a large diameter portion (3*c*), said spindle (3) being provided so that said workpiece engagement portion (3*a*) is inserted into said guide bushing (16) and projects out of said guide bushing (17), said large diameter portion (3*c*) and small diameter portion (3*b*) are rotatably fitted in said large diameter hole portion and small diameter hole portion of said guide bushing (17) and said large diameter portion (3*c*) is rotatably fitted in said small diameter hole portion of said guide bushing (16), so that said spindle (3) is supported at both ends thereof by said guide bushings (16, 17), and said spindle (3) is prevented, by a protruding member provided in said small diameter portion (3*b*) of said spindle (3), from being separated from said guide bushing (17);

a ratchet mechanism (8) installed in a space formed in said spindle (3), said space being formed inside said large diameter portion (3*c*) of said spindle (3) so as to extend from an end face of said large diameter portion (3*c*) toward said small diameter portion (3*b*); and a motion converter (7) provided in said housing (2), said motion converter (7) transmitting a rotational motion of a motor (4) installed in a proximal end portion of said housing (2) to said yoke (1) so as to swing said yoke (1) so that a ratchet pawI (8*a*) of said ratchet mechanism (8) is alternately engaged with and disengaged from said internal teeth (1*a*) of said yoke (1), thus rotating said spindle (3) in steps so that said workpiece engagement portion (3*a*) of said spindle (3) rotates a workpiece.

* * * * *